US009301619B2

(12) United States Patent
Verdier et al.

(10) Patent No.: US 9,301,619 B2
(45) Date of Patent: Apr. 5, 2016

(54) STOOL

(71) Applicant: Butterfly Therapy Solutions, LLC., Sidney, OH (US)

(72) Inventors: Nathan Myron Verdier, Sidney, OH (US); Mollie Michelle Verdier, Sidney, OH (US)

(73) Assignee: Butterfly Therapy Solutions, LLC, Sidney, OH (US)

( * ) Notice: Subject to any disclaimer, the term of this patent is extended or adjusted under 35 U.S.C. 154(b) by 0 days.

(21) Appl. No.: 14/262,231

(22) Filed: Apr. 25, 2014

(65) Prior Publication Data

US 2015/0305509 A1 Oct. 29, 2015

Related U.S. Application Data

(60) Provisional application No. 61/815,967, filed on Apr. 25, 2013.

(51) Int. Cl.

| | |
|---|---|
| ***A47C 9/00*** | (2006.01) |
| ***A47C 7/34*** | (2006.01) |
| ***A47C 7/35*** | (2006.01) |
| ***A47C 3/22*** | (2006.01) |
| *A47C 7/00* | (2006.01) |

(52) U.S. Cl.

CPC . *A47C 9/002* (2013.01); *A47C 3/22* (2013.01); *A47C 7/34* (2013.01); *A47C 7/35* (2013.01); *A47C 7/004* (2013.01)

(58) Field of Classification Search

CPC ..... A47C 9/002; A47C 7/34; A47C 7/35; A47C 7/14; A47C 3/30; A47C 3/40

USPC ..... 297/4, 313, 314, 337, 338, 339, 344.18, 297/423.1, 461

See application file for complete search history.

(56) References Cited

U.S. PATENT DOCUMENTS

| | | | | | |
|---|---|---|---|---|---|
| 759,809 | A * | 5/1904 | Farley | 297/4 | |
| 3,185,430 | A * | 5/1965 | Bernard | 248/578 | |
| 3,339,873 | A * | 9/1967 | Hale | 248/404 | |
| 3,845,926 | A * | 11/1974 | Wahls | 248/162.1 | |
| 4,101,163 | A * | 7/1978 | Morin | 297/16.1 | |
| 4,220,307 | A * | 9/1980 | Hale | 248/404 | |
| 4,232,896 | A * | 11/1980 | Caldwell | 297/4 | |
| 4,493,469 | A * | 1/1985 | Holobaugh | 248/406.1 | |
| 4,627,602 | A * | 12/1986 | Sporck | A47C 3/285 | 248/161 |
| 4,884,842 | A * | 12/1989 | Finkelstein | 297/331 | |
| 5,590,930 | A * | 1/1997 | Glockl | A47C 3/0257 | 297/258.1 |
| 5,927,797 | A * | 7/1999 | Ferguson | 297/4 | |
| 6,062,638 | A * | 5/2000 | Ferguson | 297/4 | |
| 6,893,097 | B1 * | 5/2005 | Ebensperger et al. | 297/451.4 | |
| 7,100,983 | B1 * | 9/2006 | Gant | A47C 7/14 | 108/2 |
| 7,549,387 | B2 * | 6/2009 | Funk | B63B 29/06 | 114/363 |
| 8,403,408 | B2 * | 3/2013 | Hosler | 297/4 | |
| 2005/0242630 | A1 * | 11/2005 | Miller | 297/4 | |
| 2007/0236053 | A1 * | 10/2007 | West et al. | 297/4 | |
| 2009/0230743 | A1 * | 9/2009 | Derakhshan | A47C 9/002 | 297/329 |
| 2011/0095586 | A1 * | 4/2011 | Fernandez | A47C 3/30 | 297/344.18 |

* cited by examiner

*Primary Examiner* — Adriana Figueroa
(74) *Attorney, Agent, or Firm* — Dinsmore & Shohl LLP

(57) ABSTRACT

Apparatus and methods for providing a stool with a seat, a spring device, a leg connected to spring device, and an engagement surface disposed at a distal end of the leg.

19 Claims, 5 Drawing Sheets

STOOL

CROSS-REFERENCE TO RELATED APPLICATIONS

This application claims the benefit of provisional application 61/815,967, filed Apr. 25, 2013, the entire contents of which are hereby incorporated by reference.

FIELD

The present disclosure relates generally to systems and methods for improvements in an apparatus for providing vestibular and/or sensory input. More specifically, embodiments herein detail a stool comprising a seat, a spring device, a leg, and a foot disposed at a distal end of the leg and covering at least a portion of an engagement surface which engages a floor or the ground.

SUMMARY

Embodiments shown and described herein provide for an apparatus for providing vestibular and sensory input to an occupant comprising: a stool comprising: a seat, a spring device, connected to the seat, a leg engaged to the spring device such that the seat moves relative to the leg; and an engagement surface disposed at a distal end of the leg.

One or more embodiments shown and described herein provide for a method of using a stool comprising: providing the stool; setting the stool on the floor with a foot or stand end contacting ground, ensuring that the ground is substantially flat and horizontal; sitting on the seat by resting one's posterior on the seat; making sure that the one's feet are flat on the floor and a stance is stable; ensuring that a table is at one's front, and resting one's arms on the table for stability; moving one's body in an up and down vertical direction by way of leg movement that would initiate the stool to move up and down.

Yet more specific embodiments of the present invention shown and described herein provide for a method for providing vestibular and sensory input comprising using a stool comprising: providing a seat, an outside pipe, an inside pipe and a spring device; drilling a hole through the outside pipe; cutting a slot on each side of the inside pipe to allow sliding action; welding the outside pipe to the plate; inserting the spring device into the outside pipe; inserting the inside pipe into the outside pipe; inserting a slot bolt into the hole in the outside pipe and through one of the slots on the side of the inside pipe; and attaching a foot to the bottom of the inside pipe.

BRIEF DESCRIPTION OF THE FIGURES

The following detailed description of specific embodiments of the present disclosure can be best understood when read in conjunction with the drawings enclosed herewith.

Figure 1:
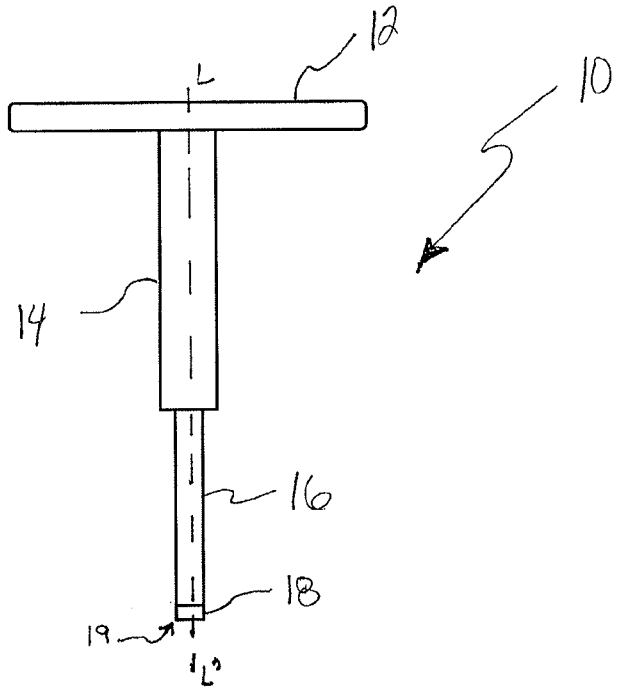
FIG. 1 is a schematic representation of an embodiment of a stool.

The embodiments set forth in the drawings are illustrative in nature and not intended to be limiting of the invention defined by the claims. Moreover, individual features of the drawings and embodiments will be more fully apparent and understood in view of the detailed description.

DETAILED DESCRIPTION

The following text sets forth a broad description of numerous different embodiments. The description is to be construed as exemplary only and does not describe every possible embodiment since describing every possible embodiment would be impractical, if not impossible, and it will be understood that any feature, characteristic, component, composition, ingredient, product, step or methodology described herein can be deleted, combined with or substituted for, in whole or part, any other feature, characteristic, component, composition, ingredient, product, step or methodology described herein. Numerous alternative embodiments could be implemented, using either current technology or technology developed after the filing date of this patent, which would still fall within the scope of the claims.

It should also be understood that, unless a term is expressly defined in this specification using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). No term is intended to be essential unless so stated. To the extent that any term recited in the claims at the end of this patent is referred to in this patent in a manner consistent with a single meaning, that is done for sake of clarity only so as to not confuse the reader, and it is not intended that such a claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph or 35 U.S.C. §112, paragraph (f).

Referring to FIG. 1, an illustrative stool 10 is shown. In this example, stool 10 includes a seat 12, a spring device 14, connected to seat 12, and a leg 16 connected to spring device 14. In this embodiment, stool 10 includes an engagement surface 19 which engages a supporting surface such as, for example, a floor or the ground. Optionally, leg 16 may include a foot 18 disposed at a distal end of the leg and/or covering at least a portion of engagement surface 19. The foot in any one or more of the embodiments shown and described herein may be configured to provide the stool a non-slip surface or increased stability. As such, the foot may comprise any hard, supportive material know in the art, including but not limited to wood, metal, plastics, rubber, polymers, etc. Additionally, the foot can comprise any shape, size or configuration, including but not limited to a flat stand, ball, or wedge. In one embodiment, foot 18 may be fabricated from a resilient material such as natural or synthetic rubber, elastomeric materials, etc., for providing a better grip to engage the supporting surface. In one embodiment, foot 18 comprises a diameter from about 1 inch to about 2 inches, but in other embodiments, foot 18 could have a diameter up to about 12 inches. Foot 18 may also include grooves and/or ridges (not shown) for providing additional grip for engagement with the supporting surface.

In one or more embodiments of stool 10, seat 12 may comprise any supportive material known in the art, including but not limited to wood, metal, plastic, composites, or any combination thereof. In certain embodiments, seat 12 is made from a semi-rigid or rigid material to sufficiently support a human occupant. Seat 12 may comprise any shape, configuration or size. It some embodiments, it is sized to accommodate a human posterior such as, for example, the posterior of children. In certain embodiments, seat 12 is shaped as a rectangle, circle, or oval, and could even include a back support in order to support the lumbar area of a human occupant. In some examples, seat 12 has a diameter from about 10 to about 16 inches and a thickness from about 0.5 inches to about 1.5 inches. It is also understood that in some embodiments of stool 10, seat 12 may include a cushion, including but not limited to conventional cushioning materials used for seats, couches, chairs, etc., (e.g., foam rubber, etc.) and/or a cover material such as, for example, vinyl, leather, synthetic leather, neoprene, polymers, nylon, wool, cotton, composite materials, conventional seat covering materials and/or combinations thereof.

In this and/or other embodiments shown and described herein, spring device 14 may include, but not be limited to, a coiled spring or compression spring, a pneumatic piston or cylinder, an air shock absorber or cylinder, a gas shock absorber or cylinder, any type of fluid-filled ball, and or any other mechanisms to provide a springing effect, load or force absorbing movement, or relative movement between an occupant of stool 10 and the supporting surface (e.g., a floor or the ground). In the example shown in FIG. 1, spring device 14 may be connected between seat 12 and leg 16 to provide this relative movement between seat 12 and leg 16 which equates to relative movement between an occupant in seat 12 and the supporting surface (e.g., a floor or the ground). The relative movement may be in multi-axis directions or limited to a certain axis such as linear movement along a longitudinal axis L-L' of stool 10.

In one embodiment, spring device 14 may include a piece of material such as, for example, metals, composites, or polymers, wherein the shape such as, for example, a series of sinusoidal waves (e.g., a series of C-shaped springs in alternating orientation to form a substantially sinusoidal-shaped curve), a single curved body (e.g., C-shaped spring such as, for example, those used in artificial legs, particularly those used for running), or a series of C-shaped springs connected together and the material properties provide for a springing effect or relative movement between seat 12 and leg 16. In another embodiment, spring device 14 comprises a pneumatic shock absorber or cylinder, wherein the shock absorber or cylinder contains a fluid and a tortuous path for the fluid to be forced therethrough, providing the spring effect or relative movement between the occupant and the surface (e.g., the ground).

In other embodiments, the order of seat 12, spring device 14, and leg 16 can be reversed such that leg 16 is positioned between seat 12 and spring device 14 (this example is not shown in the figures). In other words, a distal end of spring device 14 engages the supporting surface (e.g., a floor or the ground).

Figure 2:
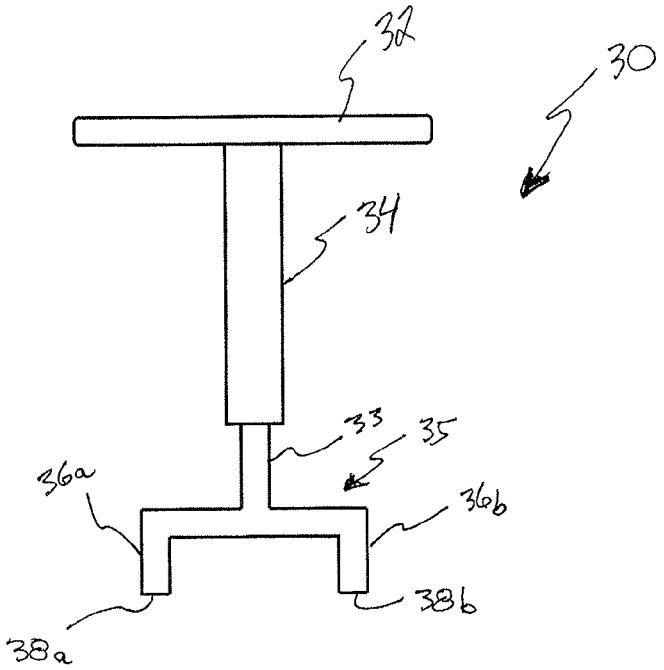
FIG. 2 is a schematic representation of another embodiment of a stool.

Referring to FIG. 2, another embodiment of a stool 30 is shown. In this example, stool 30 includes a seat 32, a spring device 34, connected to seat 32, and a leg assembly 35 connected to spring device 34. Seat 32 may comprise any configuration, shape or size and be fabricated from any of the materials, including but not limited to the seat configurations, shapes, materials, and sizes shown and described herein. Spring device 34 may comprise any one of the spring devices shown and described herein. Spring device 34 may be connected between seat 32 and leg assembly 35 as shown in FIG. 2 to provide relative movement between an occupant of stool 30 and the supporting surface, e.g., the ground.

Leg assembly 35 comprises a first support member 33 and first and second legs 36*a* and 36*b*, respectively, connected to first support member 33. First and second legs 36*a* and 36*b* each include respective first and second engagement surfaces 38*a* and 38*b*, respectively. Similar to the embodiment shown in and described with reference to FIG. 1, first and second engagement surfaces 38*a* and 38*b* may include first and second feet 39*a* and 39*b* (not shown), respectively. First and second feet may cover at least a portion of or all of respective first and second engagement surfaces 38*a* and 38*b* and may comprise any shape, size, materials and configurations, including those that have been shown and described herein with reference to other embodiments.

Figure 3:
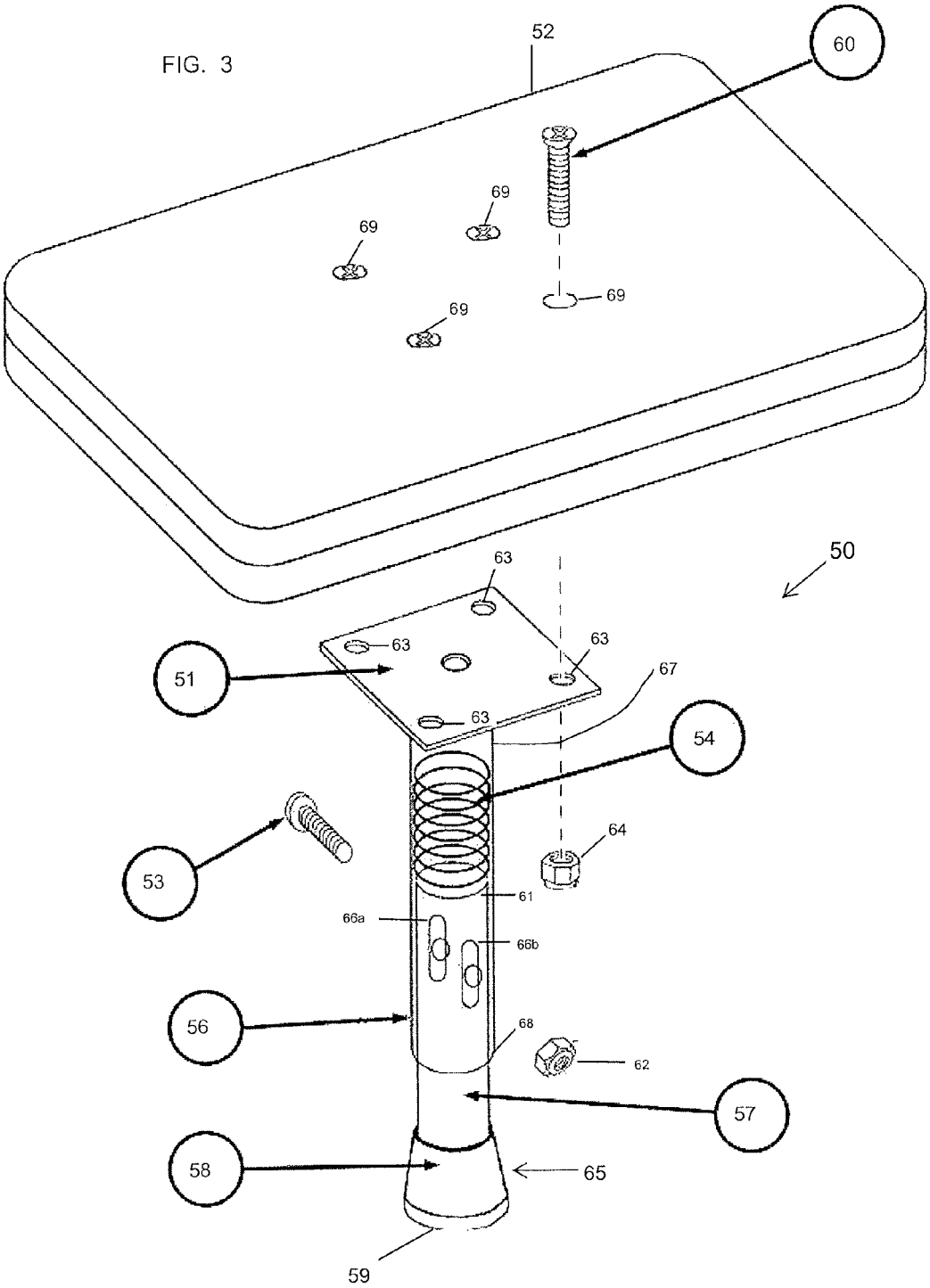
FIG. 3 is a partially exploded perspective view of another embodiment of a stool.

Referring to FIG. 3, another embodiment of a stool 50 is shown. Stool 50 includes a seat 52, a leg 57, a spring device 54 disposed between seat 52 and leg 57, and an engagement surface 59 disposed at a distal end of leg 57. Optionally, the distal end of leg 57 may comprise a foot 58 encompassing and extending over such distal end and engagement surface 59 as shown in FIG. 3. Seat 52, leg 57, spring device 54, and foot 59 may comprise any configuration, shape or size and be fabricated from any material, including but not limited to those configurations, shapes, materials, and sizes shown and described with reference to the other illustrative embodiments shown and described herein. As shown in FIG. 3 seat 52 comprises a rectangular shape and includes one or more holes 69 for receiving screws and/or bolts 60 in order to connect seat 52 to spring device 54. For illustrative purposes only, and not limitation, foot 58 may be fabricated from natural or synthetic rubber to provide a gripping engagement surface 59 for engaging the supporting surface.

Stool 50 includes a hollow outer cylinder 56 having a first end 67 and a second end 68. For illustration purposes only, and not limitation, outer cylinder 56 in FIG. 3 is shown as transparent only for the purposes of illustrating the position of the spring within outer cylinder 56. It is understood that outer cylinder 56 may be opaque, transparent, or translucent. Outer cylinder 56 may comprise a length from about 6 inches to about 14 inches and diameter from about 1 inch to about 2 inches. Outer cylinder 56 further includes a flange 51 attached to first end 67. Flange 51 may be welded to first end 67 via any welding method. Alternatively, flange 51 may be connected using any other connection methods such as bolts, screws, adhesives, hot welds, soldering, brackets, etc. In a further alternative embodiment, flange 51 may be fabricated as an integral part of outer cylinder 56. Flange 51 also may include one or more apertures 63 that are operable to receive screws and/or bolts 60. When apertures 63 are aligned with holes 69 of seat 52, screws and/or bolts 60 may be inserted therethrough and a nut 64 may be threaded onto bolt 60 to attach the seat to the flange and thus to spring device 54. However, it is understood that seat 52 may be connected to outer cylinder 56 and/or spring device 54 by any number of methods, including, but not limited to adhesives, welds, solder, hot welds, and any other conventional methods of attaching two devices.

Spring device 54 comprises a compression, coiled, or helical spring. Spring 54 may be, but not limited to, from about 3 inches to about 8 inches in length and from about 1 inch to about 2 inches wide. The spring may be inserted into an interior space of outer cylinder 56 such that one end of the spring abuts against flange 51. Flange 51 may include a bushing (not shown but similar to bushing 83 shown in FIG. 4) connected to its side that faces outer cylinder 56 using conventional methods such as, for example, welding, hot welding, soldering, adhesives, bolts, screws, etc., and positioned such that at least a portion of the bushing inserts into an interior space of the coiled spring 54 and/or abuts against or is connected to spring 54. The bushing may include a nub that is sized such that it may insert into the interior of spring 54. This bushing may assist in keeping the spring from moving around too much and/or the spring centered within outer cylinder 56.

In this embodiment, leg 57 may comprise a hollow, inner cylinder wherein a first end 61 of inner cylinder 57 is inserted into second end 68 of the outer cylinder 56 such that a second end of spring 54 (opposite the end of the spring that engages flange 51) engages and/or abuts first end 61 of inner cylinder 57. Outer cylinder 56 further includes a first slot 66*a* and a second slot 66*b* diametrically opposed along outer cylinder 56 from first slot 66*a*. Also, inner cylinder 57 includes similar first and second slots (not shown) diametrically opposed from each other along inner cylinder 57 such that when the inner cylinder is inserted into second end 68 of outer cylinder 56 the respective slots of the inner cylinder are aligned with first and second slots 66*a* and 66*b*. When aligned, a bolt 53 may be inserted through the aligned slots and then a nut 62 may be threaded thereon to hold the inner and outer cylinders together, yet permit the inner and outer cylinders to move relative to each other along a longitudinal axis of stool 50 a distance equal to or substantially equal to the length of the slots. As such, the slots may be made longer to provide a longer linearly travel of relative movement between the inner and outer cylinders, or made shorter to provide a shorter linear travel of relative movement between the inner and outer cylinders. In one embodiment, slots may be from about 1 inch to about 4 inches in length depending on the spring's size to accommodate free distance of compression.

Figure 4:
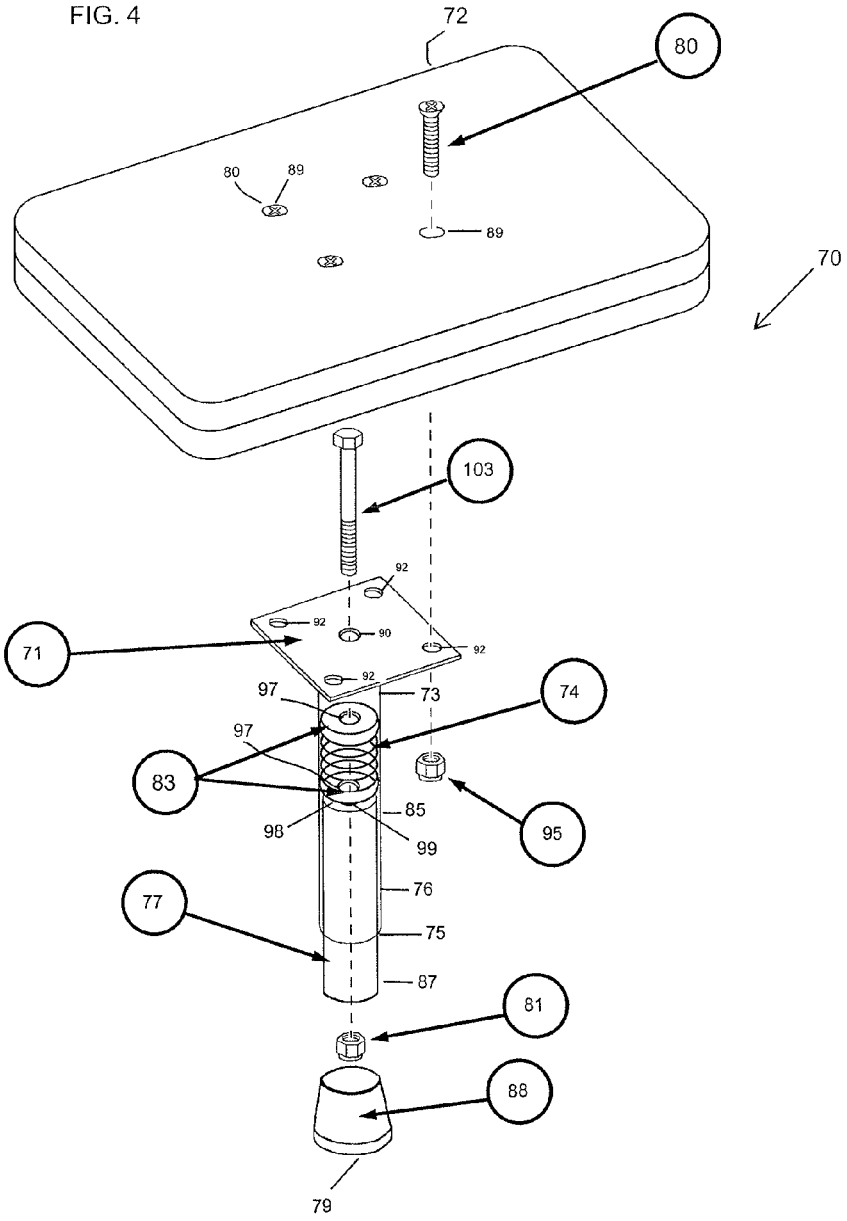
FIG. 4 is a partially exploded perspective view of another embodiment of a stool.

First end 61 of inner cylinder 57 may also include a bushing (not shown, but may be similar in design to bushing 83 shown in FIG. 4)) inserted into, abutted against, and/or connected to such first end 61. The bushing may be used to prevent spring 54 from moving around too much within outer cylinder 56 and/or keeping spring 54 centered therein. The bushing may include a nub that is sized such that it may be partially inserted into the space defined by the coils of spring 54 and/or abut against or connected to spring 54. Optionally, the bushings may be partially or completely comprised of a resilient material or include a washer of resilient material that will reduce noise caused by the spring moving against the bushings' surface during operation of the stool.

At a distal end 65 of inner cylinder 57 or at the outside and distal surface of foot 58, stool 50 includes an engaging surface 59 that engages a contacting surface such as, for example, a floor or the ground. Similar to the embodiment shown and described in FIG. 2, this embodiment of stool 50 could have one or more engaging surfaces 59. In some embodiments, stool 50 does not have more than two separate and distinct engaging surfaces. In other words, stool 50 includes two or less engaging surfaces.

Although inner cylinder 57 is shown and described above as a hollow cylinder, in other embodiments, inner cylinder could be a solid rod or beam. In such an embodiment, slots 66*a* and 66*b* could be machined (e.g., drilled or cut) through the rod or beam and the bushing could be attached to first end 61 using any connection method such as, for example, welding, adhesives, brackets, etc., and/or be connected to or abutted against first end 61. Moreover, although outer cylinder 56 and inner cylinder 57 are shown and described as cylinders, these components may comprise any shape, configuration and size such as, for example, triangular or rectangular shapes.

Referring to FIG. 4, another embodiment of a stool is shown as 70. Stool 70 includes a seat 72, a leg 77, a spring device 74 disposed between seat 72 and leg 77, and an engagement surface 79 disposed at a distal end of leg 77. Optionally, the distal end of leg 77 may comprise a foot 88 encompassing and extending over such distal end as shown in FIG. 4. Seat 72, leg 77, spring device 74, and foot 88 may comprise any configuration, shape or size and be fabricated from any material, including but not limited to those configurations, shapes, materials, and sizes shown and described with reference to the other illustrative embodiments shown and described herein. As shown in FIG. 4 seat 72 comprises a rectangular shape and includes one or more holes 89 for receiving screws and/or bolts 80 in order to connect seat 72 to one end of spring device 74, specifically in this example to flange 71.

Stool 70 includes a hollow outer cylinder 76 having a first end 73 and a second end 75. Outer cylinder 76 further includes a flange 71 attached to first end 73. For illustration purposes only, and not limitation, outer cylinder 76 in FIG. 4 is shown as transparent only for the purposes of illustrating the position of the spring within outer cylinder 76. It is understood that outer cylinder 76 may be opaque, transparent, or translucent. Flange 71 may be welded to first end 73 via any welding method. Alternatively, flange 71 may be connected using any other connection methods such as bolts, screws, adhesives, hot welds, soldering, brackets, etc. In a further alternative embodiment, flange 71 may be fabricated as an integral part of outer cylinder 76. Flange 71 also may include one or more apertures 92 that are operable to receive screws and/or bolts 80. When apertures 92 are aligned with holes 89 of seat 72, screws and/or bolts 80 may be inserted therethrough and a nut 95 may be threaded onto bolt 80 to attach the seat to the flange and thus to spring device 74. However, it is understood that seat 72 may be connected to outer cylinder 76 and/or spring device 74 by any number of methods, including, but not limited to adhesives, welds, solder, hot welds, and any other conventional methods of attaching two devices.

Spring device 74 comprises a compression, coiled, or helical spring. The spring may be inserted into an interior space of outer cylinder 76 such that one end of the spring abuts against flange 51. Flange 71 may include a bushing 83 that engages or is connected to a side of flange 71 that faces outer cylinder 76 using conventional methods such as, for example, welding, hot welding, soldering, adhesives, bolts, screws, etc., and positioned such that at least a portion of the bushing inserts into an interior space of the coiled spring 54 such that an end of spring 74 engages and/or abuts bushing 83. Bushing 83 may assist in keeping spring 74 from moving around too much and/or spring 74 centered within outer cylinder 76.

In this embodiment, leg 77 comprises a hollow, inner cylinder, wherein a first end 85 of the inner cylinder is inserted into second end 75 of outer cylinder 76 such that a second end of spring 74 (opposite the end of the spring that engages flange 71) engages and/or abuts a second bushing 83 that inserts into an interior space of spring 74 to assist with preventing the spring from moving around too much and/or keeping the spring centered within the outer cylinder 76. The second end of spring 74 may engage and/or abut against first end 85 of inner cylinder 77. First end 85 of inner cylinder may be capped with an end cap 99 or second bushing 83 may be inserted into second end 85 and attached thereto to act as and form an end cap of first end 85 of inner cylinder 77. Thus, end cap 99 would not be needed. The end cap disposed at first end 85 of inner cylinder 76 may also comprise an end cap hole 98

As shown in FIG. 4, flange 71 may include a center hole 90 and bushings 83 may include a bushing aperture 97 disposed therethrough. Additionally, first end 85 of inner cylinder 77 may include a hole 98. Center hole 90, bushing apertures 97 and end cap hole 98 are sized to receive and permit bolt 103 to be inserted and easily slide therein. Once inserted therein, a nut 81 is inserted into the second end 87 of inner cylinder 77 and threadingly engaged to bolt 103. This arrangement connects the outer cylinder 76, and thus flange 71 and seat 72, to inner cylinder 77 and engaging surface 79, yet permits engaging surface and inner cylinder 77 to move linearly along a longitudinal axis relative to outer cylinder 76, flange 71, and seat 72.

As shown in FIG. 4, first end 85 of inner cylinder 77 may also include a bushing 83 inserted into, connected to, and/or abutted against such first end 85. The bushing may be used to prevent spring 74 from moving around too much within outer cylinder 76 and/or keeping spring 74 centered therein. The bushing may be partially inserted into the space defined by the coils of spring 74.

At a distal end 87 of inner cylinder 77 or at the outside and distal surface of foot 88, stool 70 includes an engaging surface 79 that engages a contacting surface such as, for example, a floor or the ground. Similar to the embodiment shown and described in FIG. 2, this embodiment of stool 70 could have one or more engaging surfaces 79. In some embodiments, stool 70 does not have more than two separate and distinct engaging surfaces 79. In other words, stool 70 includes two or less engaging surfaces 79. Moreover, although outer cylinder 76 and inner cylinder 77 are shown and described as cylinders, these components may comprise any shape, configuration and size such as, for example, triangular or rectangular shapes.

In one or more embodiments of the stool 70, including the illustrative embodiments shown and described herein, the seat 72 may be connected to the spring device 74 and/or leg 77 using a swivel or ball joint connection to permit the seat 72 to swivel or rotate relative to the spring device 74 and/or leg. In other embodiments, the seat, flange and outer cylinder may be formed from an integral piece using such methods as plastic molding or machining from a single piece of metal.

In one or more of the embodiments shown and described herein, the stool comprises a sitting device that provides vestibular stimulation, sensory integration, proprioceptive and/or spatial awareness that helps an occupant of the stool such as, for example, an adult or child, focus while seated. Additionally, the stool may also target core muscles of an occupant for proper posture while providing the option of up and down vertical motion to the occupant. In one or more embodiments shown and described herein, the stool is configured such that it enables an occupant to sit on the stool, while simultaneously requiring the occupant to maintain balance and optionally, permitting the occupant to generate a movement along the longitudinal axis of the stool such as, for example, a vertical up and down motion or to bounce up and down. In other embodiments shown and described herein, the stool is configured such that it enables an occupant to sit on the stool, while maintaining balance and optionally permitting the occupant to move in multiple axes of direction (i.e., movement not constrained to a single axis of movement) or a single axis of direction (e.g., vertical up and down motion).

In specific embodiments, a single leg sitting stool allows for a vertical up and down motion which gives vestibular and/or sensory input to the core muscle groups. One or more of the sitting devices disclosed herein may provide vestibular stimulation, sensory integration, and/or proprioceptive and spatial awareness that helps an adult or child focus while seated, also targeting core muscles for proper posture while providing the option of up and down vertical motion. The stool may be a device configured and designed to allow a human person to sit on, while having to maintain balance, and/or having the ability to bounce in an up and down motion. The seat may comprise any hard, supportive material known in the art, including but not limited to wood, metal, and plastic. In specific embodiments the seat may be shaped as a rectangle or circle, but could take any other shape, such as an oval, or have a backing to support the lumbar area. It is sized to accommodate a human posterior, and may have a diameter from about 10 to about 16 inches and a thickness from about 0.5 inches to about 1.5 inches. The seat bolt may comprise of any number of objects known in the art, used to secure the seat to the plate. These could include but not be limited to any bolt or screw made of wood, metal, or plastic. The bolt may be a flat head bolt, but could be any type of bolt, such as hex head, or oval head. The length may be 1" inch, but could be longer depending on seat size. The plate is configured and designed to attach the seat to outside pipe. It may comprise any hard, supported material known in the art, including but not limited to wood, metal, and plastic. The plate is to have holes to accommodate bolts to attach to seat. There may be four holes in the plate but could be any number of holes. The plate may be shaped as a square, but could take any other shape, such as an oval or rectangle. It may be configured as a square with 3"-4" sides. The slot bolt is configured to keep the outer pipe and inner pipe together. The bolt may comprise any hard, supportive material know in the art, including but not limited to wood, metal, and plastic. The bolt may be a hex head bolt, but could be any other form of bolt or pin. The bolt may be from about 1.5 inches to about 3 inches in length. The nut is used to secure the seat bolt and slot bolt. The nut may be a lock nut, but could be any other form of secure object.

The spring can be a device configured and designed to allow a person to bounce up and down while sitting on seat. The spring may comprise of any hard, supportive material known in the art, including but not limited to wood, metal, and plastic. The spring may be a compression spring, but could be any other type of spring, or object that accomplishes the objective of a cushioned up and down movement for example, any type of ball or series of balls, pneumatic cylinder, gas spring or shock, air spring or shock, etc. The spring may be from about 3" to about 8" in length and from about 1" to about 2" wide. The inside pipe can be a device configured to slide inside the outside pipe, and will rest against the spring. The inside pipe may comprise any hard, supportive material known in the art, including but not limited to wood, metal, and plastic. The inside pipe will have a slot cut into it to accommodate slot bolt. The slot is from about 1" to about 4" in length depending on spring size to accommodate free distance of compression. The inside pipe may be shaped as a cylinder, but could take any other shape, such as a triangle or oval. The inside pipe may have a length of from about 6" to about 14" and diameter from about 1" to about 2". The foot can be configured and designed to attach to the bottom of inside pipe as to create a non slip surface or increased stability.

The foot may comprise any hard, supportive material known in the art, including but not limited to wood, metal, rubber and plastic. The foot could also be use as a stand, to support the stool. The foot may be shaped as a circle, but could take any other shape, such as a flat stand, ball, or wedge. The foot may be from about 1" to about 2" in diameter, but could be up to about 12" in diameter. The outside pipe may be attached to plate by way of welding, but may be attached by other means, such as adhesive or any other means. The outside pipe may comprise any hard, supportive material known in the art, including but not limited to wood, metal, and plastic. The outside pipe may have a hole on each side to accommodate slot bolt to prohibit inside pipe from sliding apart from outside pipe. The outside pipe may be shaped as a cylinder, but could take any other shape, such as a triangle or oval. The outside pipe may have a length from about 6" to about 14" and diameter from about 1" to about 2". An optional setup that would eliminate the slot bolt and slot in the Togo would be to use a bolt that is inserted through a center hole on the seat plate of the outside pipe, long enough to slide through the spring and into the inside pipe. The inside pipe would have to be capped on the end that is in the outside pipe, and have to have a hole big enough to accommodate the bolt. A nut or a lock nut may be used to secure the stool together. There could also be a nub or seat, inserted or permanently fastened to the inside of the seat plate, and also to the end of the inside pipe that seats against the spring. This is to keep the spring in a secure position so it will not slide around inside the pipe and cause it to rub against the wall of the pipe resulting in excessive noise and wear. This nub or seat could comprise of metal or plastic or any other material that would give the same result. The foot may slide onto end of inside pipe but could be attached in any number of ways including, but not limited to screws, bolts, adhesives, etc. The foot may, but is not limited to be in the form of a rubber ball shape, tear drop shape, flat stand, or reverse wedge shape to accommodate use. The foot may not be a foot at all but could be a stand to increase stability.

Figure 6:
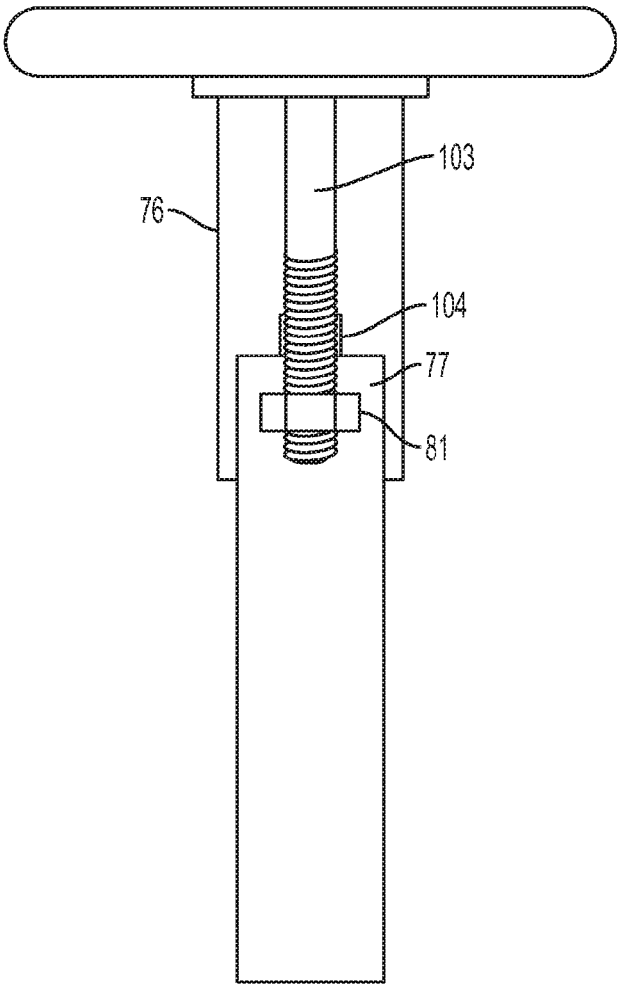
FIG. 6 is a schematic illustrating the nipple as described herein.

In specific embodiments, rather than a bushing 83, a nipple 104 (FIG. 6) can be placed at one or both ends of the spring to center the spring device, to prevent the spring from moving (for example preventing lateral movement while allowing the spring to expand and contract), or to provide a snug fit for the spring device.

In specific embodiments the apparatus can have from about 1-5 feet and/or legs. In other embodiments the apparatus has one leg and/or only one foot. In other embodiments the apparatus has two feet.

Figure 5:
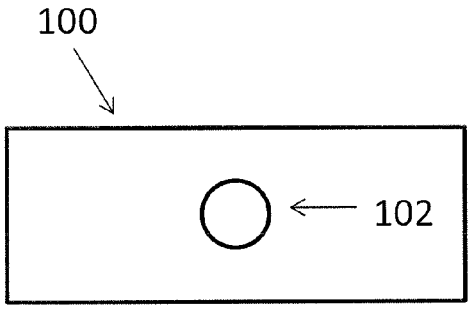
FIG. 5 is a stabilizing structure with a hole configured to accept the foot.

In specific embodiments the apparatus engages a stabilizing structure 100. The stabilizing structure 100 (FIG. 5) can be a platform between the floor and the apparatus that can be weighted that provides stability. The stabilizing structure can be of any shape or size, but in specific embodiments is flat and contains a hole 102 that the foot can rest in to provide stability for the apparatus. In specific embodiments there can be one, two, three, four, or five holes to match the number of legs and/or feet of the apparatus.

In specific embodiments the apparatus can be configured such that the spring device 74 is removable and can be configured such that 3 different spring devices of three different stiffnesses can be exchanged within a single apparatus. In specific embodiments one of the springs is configured to hold at least 200 pounds. In a non-limiting example, the apparatus can be configured to accept one or more springs such as: a heavy spring such as one having a length of about five inches, an inner diameter (ID) of about 0.7760 inches and an outer diameter of about 1.1000 inches, capable of carrying a load of about 273.1234 pounds. In another non-limiting example, the apparatus can be configured to accept one or more springs such as: a light spring such as one having a length of about five inches, an inner diameter (ID) of about 0.8040 inches and an outer diameter of about 1.1000 inches, capable of carrying a load of about 135.76 pounds. In specific embodiments the springs can be from about 4 to about 6 inches in length, and in specific embodiments the spring can be about 4, about 5, or about 6 inches in length. In specific embodiments the light spring can carry from about 125 to about 175 pounds, and the in specific embodiments the heavy spring can carry about 200 to about 250 pounds or more. In specific embodiments the apparatus/stool can accept any one of three springs, which include an intermediate spring configured to carry weight between the ranges of the light spring and the heavy spring. In specific embodiments a spring will carry at least 125 pounds.

In specific embodiments, the apparatus herein is not a pogo stick.

In specific embodiments provided herein, an apparatus or method may comprise one or more of: the foot configured to provide the stool a non-slip surface or increased stability; the foot comprising wood, metal, or plastic, as well as the apparatus having exactly one foot, or exactly two feet; the seat only moves linearly with respect to the leg; the apparatus can accept any one of three springs; the apparatus is configured to accept a spring of from about 4 to about 6 inches in length and will carry at least 125 pounds (the spring will function properly at the level of at least 125 pounds); the foot comprising a diameter from about 1 inch to about 2 inches; the foot comprising a diameter of up to about 12 inches; the seat moves in a polyaxial direction with respect to the leg (the seat can move linearly to or at an angle with the leg from for example from 0 to 90 degrees); the foot configured to engage a stabilizing structure by friction fit into a hole in the stabilizing structure; the foot configured to engage a stabilizing structure, being secured with a fastening device that is a screw or a bolt; the leg comprising a hollow, inner cylinder wherein a first end of the inner cylinder is inserted into an end of an outer cylinder; the inner cylinder comprising a bushing to prevent the spring from moving; the inner cylinder comprising a bushing to keep the spring centered therein; the bushing partially inserted into the space defined by coils of the spring; a flange configured to couple to the underside of the seat; the flange having at least four apertures for coupling to the seat; and/or the flange is flat and square in shape.

The invention claimed is:

1. A stool for providing vestibular and sensory input to an occupant comprising:

a seat, an outer cylinder coupled to the seat via a flange therebetween such that the seat, the outer cylinder, and the flange move as a single unit vertically in relation to a leg, the flange being threadingly engaged to the leg via a coupling extending from the flange vertically downward through a spring device, through a nipple, the threading engagement being within and against a top inside portion of the leg;

the spring device resting on a top exterior portion of the leg, the spring device centered at a bottom end via the nipple preventing lateral movement;

the leg engaged to the spring device such that the seat, the outer cylinder, and the flange move as the single unit vertically upward relative to the leg via only the spring device and downward via only a motion of an occupant; and an engagement surface disposed at a distal end of the leg.

2. The stool of claim 1, further comprising a foot covering at least a portion of the engagement surface and configured to provide the stool a non-slip surface or increased stability.

3. The stool of claim 2 wherein the foot comprises wood, metal, or plastic and the apparatus has exactly one foot.

4. The stool of claim 2 wherein the seat only moves linearly with respect to the leg.

5. The stool of claim 2 wherein the foot comprises a resilient material.

6. The stool of claim 2 wherein the apparatus comprises three interchangeable springs each of a different stiffness.

7. The stool of claim 2 wherein the apparatus is configured to accept the spring device comprising a spring of from about 4 to about 6 inches in length and that will carry at least 125 pounds.

8. The stool of claim 2 wherein the foot comprises a diameter of up to about 12 inches.

9. The stool of claim 2 wherein the seat moves in a polyaxial direction with respect to the leg.

10. The stool of claim 2 wherein the foot is configured to engage a stabilizing structure by friction fit into a hole in the stabilizing structure, the stabilizing structure comprising a platform between a floor and the apparatus that is weighted to provide stability.

11. The stool of claim 2 wherein the foot is configured to engage a stabilizing structure, being secured with a fastening device that is a screw or a bolt, the stabilizing structure comprising a platform between a floor and the apparatus that is weighted to provide stability.

12. The stool of claim 1 wherein the leg comprises a hollow, inner cylinder wherein a first end of the inner cylinder is inserted into an end of the outer cylinder.

13. The stool of claim 12 wherein the inner cylinder comprises a bushing engaging the spring.

14. The stool of claim 12 wherein the inner cylinder comprises a bushing to keep the spring device centered therein.

15. The stool of claim 14 wherein the bushing is partially inserted into the space defined by coils of the spring device.

16. The stool of claim 1 wherein the flange has at least four apertures for coupling to the seat.

17. The stool of claim 1 wherein the flange is flat and square in shape.

18. A method for providing vestibular and sensory input comprising using a stool comprising:

providing the stool comprising a seat, an outer cylinder coupled to the seat via a flange therebetween such that the seat, the outer cylinder, and the flange move as a single unit vertically in relation to a leg, the flange being threadingly engaged to the leg via a coupling extending from the flange vertically downward through a spring device, through a nipple, the threading engagement being within and against a top inside portion of the leg; the spring device resting on a top exterior portion of the leg, the spring device centered at a bottom end via the nipple preventing lateral movement; the leg engaged to the spring device such that the seat, the outer cylinder, and the flange move as the single unit vertically upward relative to the leg via only the spring device and downward via only a motion of an occupant; and an engagement surface disposed at a distal end of the leg;

setting the stool on a floor;

sitting on a seat of the stool by resting one's posterior on the seat;

making sure that the one's feet are flat on the floor and a stance is stable;

ensuring that a table is at one's front, and resting one's arms on the table for stability; and moving one's body in an up and down vertical direction by way of leg movement that would initiate the stool to move up and down such that the seat, the outer cylinder, and the flange move as the single unit vertically upward relative to the leg via only the spring device and downward via only the motion of the occupant.

19. A method of making a stool for providing vestibular and sensory input to an occupant comprising:

providing a seat, an outer cylinder, a flange comprising a plate, a leg comprising an inner cylinder, a spring, and an engagement surface;

drilling a hole through the outer cylinder;

welding the outer cylinder to the plate;

coupling the outer cylinder to the seat via the plate therebetween such that the seat, the outer cylinder, and the plate move as a single unit vertically in relation to the inner cylinder;

inserting the spring into the outer cylinder;

inserting the inner cylinder into the outer cylinder; and engaging the flange via a threading engagement to the leg via a coupling extending from the flange vertically downward through the spring, through a nipple, the threading engagement being within and against a top inside portion of the leg such that the spring rests on a top exterior portion of the inner cylinder and is centered at a bottom end via the nipple preventing lateral movement of the spring, the inner cylinder engaged to the spring device such that the seat, the outer cylinder, and the flange move as the single unit vertically upward relative to the leg via only the spring device and downward via only a motion of an occupant.

* * * * *